United States Patent [19]

McGovern

[11] Patent Number: 4,700,417

[45] Date of Patent: Oct. 20, 1987

[54] GURNEY EXTENSION

[76] Inventor: Lorayne McGovern, 73 Acorn St., Bridgeport, Conn. 06606

[21] Appl. No.: 886,016

[22] Filed: Jul. 16, 1986

[51] Int. Cl.[4] ..... A61G 7/10

[52] U.S. Cl. ..... 5/81 R; 5/61

[58] Field of Search ..... 5/81 R, 81 B, 81 C, 5/86, 61; 296/20

[56] References Cited

U.S. PATENT DOCUMENTS

| | | | |
|---|---|---|---|
| 1,334,901 | 3/1920 | Migdon | 5/61 |
| 2,665,432 | 1/1954 | Butler | 5/86 |
| 2,812,524 | 4/1957 | Pruitt | 5/81 R |
| 3,593,351 | 7/1971 | Dove | 5/81 R |
| 4,012,799 | 3/1977 | Rutherford | 5/81 R |

*Primary Examiner*—Alexander Grosz

*Attorney, Agent, or Firm*—CTC & Associates

[57] ABSTRACT

This invention provides means for transferring a person from a stationary place to a movable stretcher using a flexible and foldable transfer sheet attached to such stretcher.

5 Claims, 3 Drawing Figures

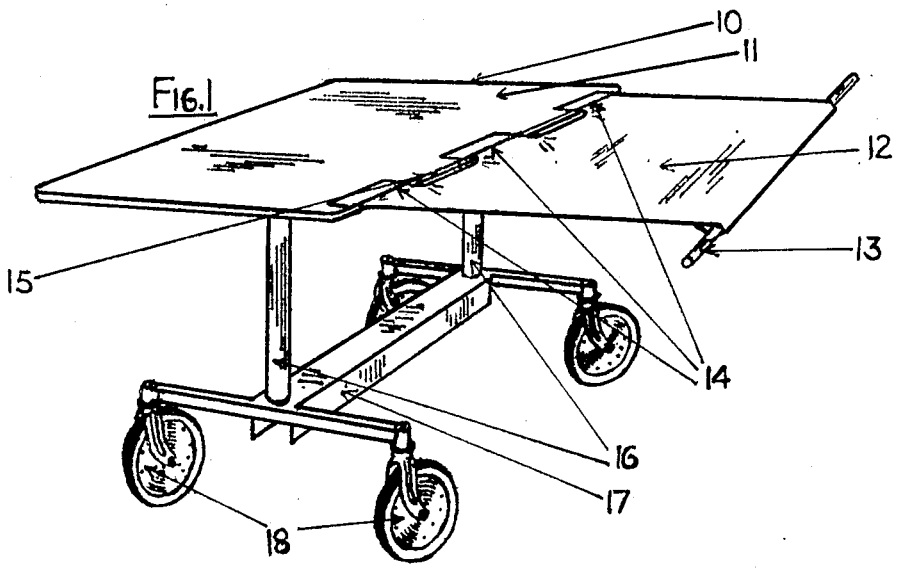
FIG. 1
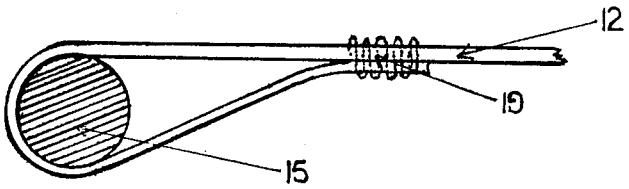
FIG. 2
FIG. 3
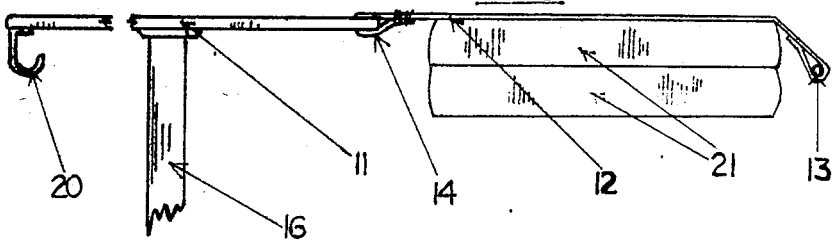

GURNEY EXTENSION

This invention is concerned with a means and method for transferring patients from an essentially stationary place of rest such as from a hospital bed to a movable stretcher (also known as a gurney) and vice versa.

BACKGROUND OF THE INVENTION

In homes for the elderly, hospitals or other places dealing with healthcare of people, the moving about of patients by means of a gurney is an inevitable necessity, however, such task has to be carried out safely and without undue inconvenience to the patient and to the people handling such patient.

Many such means have been suggested or used, as disclosed by these references of interest.

U.S. Pat. No. 3,265,432 (Tabbert) discloses a hospital stretcher being equipped with a top which moves in a lengthwise direction if the foot end of the top is dropped. There are no provisions indicated for moving a patient from bed to stretcher etc.

U.S. Pat. No. 3,304,116 (Stryker) teaches a wheeled carriage capable to support a removable stretcher. There is no disclosure facilitating the moving of a patient from bed to such stretcher.

U.S. Pat. No. 3,341,246 (Lavallee) is concerned with wheeled hospital stretcher comprising a platform or litter which may be tilted sideways and which has on each side retractable guard rails; at least one end of the litter being equipped with a movable head rest. No mention whatever is made of the means and method of this invention for transferring a patient from bed to the stretcher, etc.

U.S. Pat. No. 3,493,979 (Koll et al) deals with a patient transfer device consisting of two rotatable belts; the device may be placed adjacent to a patient on a bed and cause the patient to be lifted onto the device. The device may be retractable into a stretcher type vehicle. This is a complicated and costly apparatus which is belived not to eliminate the use for lifting a patient onto a device of substantial thickness. No similarities in construction between this disclosure and the present invention are apparent.

U.S. Pat. No. 4,019,772 (Lee) shows a hospital stretcher vehicle having lifting means for a stretcher and the like far enough apart to receive an operating table, etc. between such means allowing lowering a patient onto such table without manually lifting a patient. Nowhere is there any disclosure of the means and method of this invention.

It is believed that the present invention can accomplish the stated intend and that of the above reference in a simpler, less expensive yet more efficient way.

It is therefore the object of this invention to provide a transfer sheet for a gurney and similar vehicle;

It is another object of this invention to facilitate improved transfer of patients or people unable to move at their own ability or risk from an essentially stationary place such as bed or operating table, to a gurney and vice versa;

It is still another object of this invention to allow such transfer of patients without the need to lift patients for any extended period of time, over a distance or to any undue height;

A further object of this invention rests with the ability to readily modify existing gurney type equipment in order to achieve the advantages of this invention.

Other objects of this invention shall become apparent in the description and drawings below.

BRIEF DESCRIPTION OF THE DRAWINGS

FIG. 1 is a perspective view of a gurney having a transfer sheet of this invention attached thereto, the latter being stretched out;

FIG. 2 shows means for fastening transfer sheet to the side of a gurney;

FIG. 3 provides a simplified side view of a transfer sheet of this invention being extended from the gurney and stretching over the width of a bed (only two layers of mattresses shown).

DESCRIPTION OF THE PREFERRED EMBODIMENT

In FIG. 1 there is represented a simple gurney 10 equipped with platform 11 the latter being supported by columns 16 which are resting on base frame 17 which also carries four multidirectionally movable wheels 18; to one side of platform 11 is fastened transfer sheet 12 at points 14 of platform reinforcing bar (not shown in FIG. 1); transfer sheet 12 carries at the side opposite to the platform a holding bar 13 which extends beyond the width of said transfer sheet allowing handling and securing the transfer sheet as well as, if so desired, rolling up of transfer sheet when not in use.

FIG. 2 indicates how transfer sheet 12 may be fastened to the side of platform 11 by means of a reinforcing bar 15 by overlapping said bar 15 with sheet material sufficient to allowing transfer sheet to be attached; e.g., sewn onto itself at point 19 therefore forming a loop around bar 15.

In similar fashion, holding bar 13 may be held in place at the other end as is demonstrated in FIG. 3, which shows how transfer sheet 12 may be placed in its outstretched state from platform 11 over a bed, as indicated in a stylized form by mattresses 21; it is recognized that preferably transfer sheet 12 is wide enough to cover the full width of the bed. In an abbreviated manner, FIG. 3 also indicates platform 11 being supported by column 16, and transfer sheet 12 having been fastened to one side of platform 11.

As already mentioned, the bar 13 serves several purposes such as a means for holding, pulling or rolling up transfer sheet 12, however, as much as such a bar 13 is a preferred embodiment of this invention, other means for pulling or stretching transfer sheet 12 may be chosen such as loops, rings, ties or the like.

Transfer sheet 12 may be prepared from woven fabric or solid flexible sheeting; for the preferred fabric construction the well known fibers may be employed such as based on cotton, sisal, cellulosics, polyester, polyamide, polyacetate, polyacrylate, polyurethane, aramide or combinations thereof; the sheeting type transfer sheet may also be prepared from one or more of the above mentioned synthetic materials.

The holding bar 13 may be prepared from steel, aluminum, wood or plastic, the latter preferably containing metal rod reinforcement.

Where the transfer sheet is attached to the platform or carries a holding rod and is therefore folded onto itself at the fastening points, the overlapping portions may suitably be held together by sewing, stapling or any kind of fastening device that is safe, not detrimental to the patient's health and comfortable to the body upon contact. Although in the Figures it is indicated that the transfer sheet is fastened onto a reinforcing bar 15 of platform 11, other means for having the gurney carry a transfer sheet may be chosen, in each case care to be taken that the transfer sheet of this invention be kept in as close as possible proximity to the platform of the gurney. The transfer sheet may also alternatively be made an intergral part of a sheet or fabric cover serving as platform of the gurney (see also below).

It will be understood that the instant descriptions and drawings concentrate on the essentials of this invention with the result that certain items have not been displayed, yet are believed to be well within the public domain and understanding; such items include brakes or locks for the gurney, means for raising/lowering or tilting the platform of said gurney. For that matter, no particular shape for the platform is implied, although usually such platforms are essentially rectangular. In addition, a gurrney may be equipped on either long side with a transfer sheet of this invention. Furthermore, the platform may be of solid construction such as made from wood, metal or plastic or may comprise a sheet type material made for instance from fabric stretched on a frame permanently or detachably.

Whichever type of gurney and means for equipping such gurney with a patient transfer sheet of this invention, the method for transferring a person such as a patient from a bed or similar place remains essentially the same and comprises extending the transfer sheet under the person over the width of such bed, pulling the end of the transfer sheet having the holding bar or other holding means over the person and continuing pulling causing the person to safely roll onto the gurney. Once the transfer is completed, the transfer sheet may optionally be secured on the other side of the gurney thereby providing means for holding the patient on the gurney (see FIG. 3 item 20).

In order to transfer the patient or person to the bed or other place of rest, essentially the reverse above procedure is employed; i.e., the transfer sheet is removed from the person and laid across the bed, the patient is either rolled or pulled across the transfer sheet onto the bed and finally the transfer sheet is removed from under the patient.

It should be understood that the descriptions and drawings are for the purpose of illustration only, modifications, equivalents and variations are considered to fall within the scope of the appended claims.

What is claimed is:

1. A means suitable for transferring a person from a stationary place onto a gurney comprising a gurney having a reinforcing bar along at least one side of its platform and having permanently attached to said reinforcing bar a flexible transfer sheet, said transfer sheet having about the length of said platform, the width greater than that of a person and having at the opposite side a holding means selected from the group consisting of loops, rings, ties and a bar.

2. The means of claim 1 wherein said flexible transfer sheet is selected from the group consisting of solid sheet and woven fabric.

3. The means of claim 2 wherein said flexible transfer sheet is a solid sheet made from polyethylene, polypropylene, poly(vinyl chloride), polyacrylate, polyester, polyamide, polyacetate, polyurethane, aramide or mixtures thereof.

4. The means of claim 2 wherein said transfer sheet is a woven fabric made from cotton, sisal, cellulosics, polyacrylate, polyester, polyacetate, polyurethane, aramide, polyamide or mixtures thereof.

5. A method for moving a person from an essentially stationary place onto a gurney comprising providing a gurney having a reinforcing bar along at least one side of its platform and having permanently attached to said reinforcing bar a flexible transfer sheet, said transfer sheet having about the length of said platform, the width greater than that of a person and having at the opposite side a holding means selected from the group consisting of loops, rings, ties and a bar; extending said transfer sheet under said person over said stationary place, pulling the loose end of said transfer sheet over said person towards said platform causing said person to roll onto said platform.

* * * * *